US010344505B2

(12) United States Patent
Yun

(10) Patent No.: US 10,344,505 B2
(45) Date of Patent: Jul. 9, 2019

(54) OPENING PREVENTION DEVICE FOR SLIDING DOOR OF VEHICLE

(71) Applicant: Hyundai Motor Company, Seoul (KR)

(72) Inventor: Hyung-In Yun, Incheon (KR)

(73) Assignee: Hyundai Motor Company, Seoul (KR)

( * ) Notice: Subject to any disclaimer, the term of this patent is extended or adjusted under 35 U.S.C. 154(b) by 715 days.

(21) Appl. No.: 14/942,217

(22) Filed: Nov. 16, 2015

(65) Prior Publication Data

US 2017/0081885 A1 Mar. 23, 2017

(30) Foreign Application Priority Data

Sep. 17, 2015 (KR) ..... 10-2015-0131529

(51) Int. Cl.

| | |
|---|---|
| ***E05B 81/06*** | (2014.01) |
| ***E05B 77/54*** | (2014.01) |
| ***E05F 15/40*** | (2015.01) |
| ***E05F 15/72*** | (2015.01) |
| ***E05B 81/04*** | (2014.01) |
| ***E05B 83/40*** | (2014.01) |
| ***E05C 1/08*** | (2006.01) |
| ***E05D 15/06*** | (2006.01) |
| ***E05F 15/70*** | (2015.01) |
| *E05B 81/34* | (2014.01) |

(Continued)

(52) U.S. Cl.

CPC ..... *E05B 77/54* (2013.01); *E05B 81/04* (2013.01); *E05B 81/06* (2013.01); *E05B 83/40* (2013.01); *E05C 1/08* (2013.01); *E05D 15/0621* (2013.01); *E05F 15/40* (2015.01); *E05F 15/70* (2015.01); *E05F 15/72* (2015.01); *E05B 81/34* (2013.01); *E05C 17/60* (2013.01); *E05F 15/632* (2015.01); *E05Y 2400/44* (2013.01); *E05Y 2900/50* (2013.01); *E05Y 2900/531* (2013.01)

(58) Field of Classification Search

USPC ..... 292/341.15–341.17

See application file for complete search history.

(56) References Cited

U.S. PATENT DOCUMENTS 5,172,947 A * 12/1992 Schap ..... E05B 81/22 292/201
5,273,325 A * 12/1993 Zimmermann ..... E05B 81/22 292/216

(Continued)

FOREIGN PATENT DOCUMENTS

| | | |
|---|---|---|
| KR | 2007-0051478 A | 5/2007 |
| KR | 2009-0036347 A | 4/2009 |
| KR | 2012-0032614 A | 4/2012 |

*Primary Examiner* — Carlos Lugo

(74) *Attorney, Agent, or Firm* — Mintz Levin Cohn Ferris Glovsky and Popeo, P.C.; Peter F. Corless

(57) ABSTRACT

An opening prevention device for a sliding door which is slidably installed in a side surface of a vehicle is provided. The opening prevention device includes a vehicle movement detection unit that is installed within a vehicle body of the vehicle and is configured to detect movement of the vehicle, and a door opening prevention unit that is installed in the vehicle body and configured to prevent lateral translation of the sliding door when the vehicle movement detection unit detects movement of the vehicle. Additionally, an opening prevention latch is installed on the sliding door to be engageable with a portion of the door opening prevention unit.

7 Claims, 4 Drawing Sheets

(51) Int. Cl.
*E05F 15/632* (2015.01)
*E05C 17/60* (2006.01)

(56) References Cited

U.S. PATENT DOCUMENTS 5,295,720 A * 3/1994 Budde ..... E05B 81/22 292/201
5,765,886 A * 6/1998 Buchanan, Jr. ..... E05B 81/22 292/341.16
5,907,286 A * 5/1999 Kuma ..... G07C 9/00142 235/379
5,979,971 A * 11/1999 Mizuki ..... E05B 65/0811 292/219
6,167,770 B1 * 1/2001 Nass ..... E05B 81/20 292/216
6,312,045 B2 * 11/2001 Kitagawa ..... B62D 25/02 292/24
6,359,762 B1 * 3/2002 Yokomori ..... E05B 81/20 361/115
6,581,990 B1 * 6/2003 Menke ..... E05B 81/22 292/201
6,666,487 B2 * 12/2003 Oxley ..... E05B 81/22 292/144
6,729,072 B1 * 5/2004 Somnay ..... B60J 5/06 292/144
6,859,726 B2 * 2/2005 Choi ..... G01C 21/3446 340/905
6,925,942 B2 8/2005 Yokomori
7,267,391 B2 * 9/2007 Yokomori ..... B60J 5/06 296/155
7,271,725 B2 * 9/2007 Sugiyama ..... B60R 25/257 235/384
7,275,774 B2 * 10/2007 Oberheide ..... E05B 81/22 292/144
7,341,292 B2 * 3/2008 Brose ..... E05B 81/22 292/341.15
7,445,258 B2 * 11/2008 Rice ..... E05B 81/22 292/341.16
7,703,838 B2 * 4/2010 Yokomori ..... F16D 27/118 296/146.4
2012/0175896 A1 7/2012 Martinez

* cited by examiner

OPENING PREVENTION DEVICE FOR SLIDING DOOR OF VEHICLE

CROSS-REFERENCE TO RELATED APPLICATIONS

This application claims priority to Korean Patent Application No. 10-2015-0131529, filed on Sep. 17, 2015 which is incorporated herein by reference in its entirety.

BACKGROUND

Technical Field

The present invention relates to a sliding door installed in a vehicle, and more particularly, to an opening prevention device for a sliding door of a vehicle to prevent the sliding door from opening even when the vehicle moves with the sliding door partially ajar, thus preventing a passenger from falling out of the vehicle.

Description of Related Art

Typically, vehicles include a variety of door types. For example vehicle often include a sliding door which is opened and closed in a sliding manner. As shown in FIG. 1, the sliding door 2 is installed in a vehicle, particularly, a van 1 or the like, to allows passengers egress and ingress to the vehicle. The van 1 is able to accommodate a larger number of passengers compared to general sedans. Further, the van 1 is smaller than buses so that driving on a narrow road is possible, and is widely used for transportation of children to or from preschools, private educational institutes, etc. With a door latch released, the sliding door 2 is allowed to be opened or closed in a sliding manner by a manipulation force applied thereto toward the front or rear of the vehicle.

However, the sliding door 2 may also open due to inertia or its own weight when the door latch is released. When the door is not secured by the door latch, the sliding door 2 may be opened by inertia due to movement of the vehicle. In other words, there is a risk of a passenger unintentionally exiting (e.g., falling out) the vehicle during operation of the vehicle. For example, despite improperly closing and failing to secure the sliding door 2, when a driver erroneously determines that the sliding door 2 has been completely closed and starts to move the vehicle, or when an inside handle of the sliding door 2 is manipulated within the vehicle after the vehicle has started to move, the sliding door 2 may undesirably open, thus creating a risk for a passenger to unintentionally exit (e.g., falling out) the vehicle during operation. Accordingly, when the van 1 initiates movement with the sliding door 2 improperly secured (e.g., ajar or partially ajar), an accident of a passenger unintentionally exiting (e.g., falling out) the vehicle during operation due to opening of the sliding door 2 may occur, thus compromising passenger safety and potentially causing loss of lives.

The above information disclosed in this section is merely for enhancement of understanding of the background of the invention and therefore it may contain information that does not form the prior art that is already known in this country to a person of ordinary skill in the art.

SUMMARY

The present invention provides an opening prevention device for sliding doors of vehicles which detects movement of the vehicle and prevents the sliding door from opening when the sliding door is in an unsecured state.

In one aspect, according to an exemplary embodiment of the present invention, an opening prevention device for a sliding door which is slidably installed in a side surface of a vehicle may include a vehicle movement detection unit installed in a vehicle body of the vehicle and configured to detect movement of the vehicle. A door opening prevention unit may be installed in the vehicle body and may be configured to prevent lateral translation of the sliding door when the vehicle movement detection unit detects movement of the vehicle. Further, an opening prevention latch may be installed on the sliding door to be engageable with a portion of the door opening prevention unit.

The vehicle movement detection unit may further include a gyro sensor. The opening prevention latch may have a 'C' shape having a closed first end and an open second end. The first end may be coupled to a portion of the sliding door, and the second end may be disposed to protrude from the sliding door. The second end of the opening prevention latch may engage with the door opening prevention unit when the vehicle movement detection unit detects the movement of the vehicle and the door opening prevention unit may be operate.

In particular, the opening prevention latch may be obliquely oriented adjacent to a portion on which the door opening prevention unit is installed. The door opening prevention unit may include a drive motor and a striker installed and may be configured to be rotated by the drive motor, and may be configured to selectively enter a trajectory (e.g., path) of movement of the opening prevention latch based on whether the vehicle movement detection unit detects the movement of the vehicle, and engages the opening prevention latch.

When the vehicle movement detection unit detects the movement of the vehicle, the striker may be configured to rotate by operation of the drive motor and the striker may enter the trajectory of the movement of the opening prevention latch and may engage the opening prevention latch. When the vehicle movement detection unit detects no movement of the vehicle, the striker may be maintained in a state removed from the trajectory of the movement of the opening prevention latch. At least one gear may be installed on the drive motor, and the striker may be provided on a final driven gear of the at least one gear. The striker may have a rod shape that protrudes from the final driven gear.

The opening prevention device may further include a controller that may be configured to operate the door opening prevention unit when the vehicle movement detection unit detects the movement of the vehicle. When the sliding door is securely fastened (e.g., completely closed) to the vehicle body, the controller may not operate the door opening prevention unit although the vehicle movement detection unit detects the movement of the vehicle.

BRIEF DESCRIPTION OF THE DRAWINGS

The above and other features of the present disclosure will be more apparent from the following detailed description taken in conjunction with the accompanying drawings.

DETAILED DESCRIPTION

Figure 1:
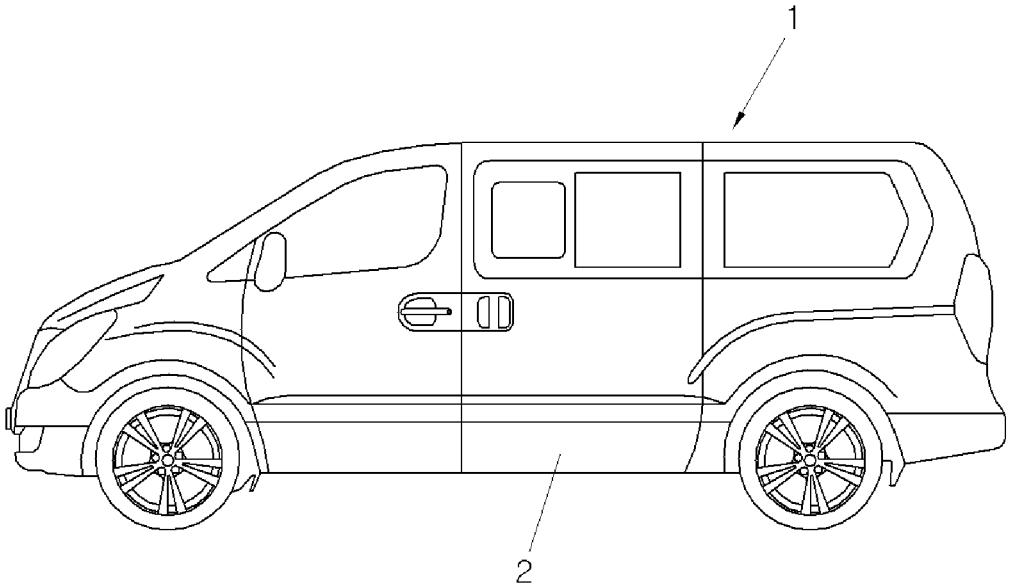
FIG. 1 Related Art
FIG. 1 is an exemplary side view showing a typical van according to the related art.

Advantages and features of the invention and methods of accomplishing the same may be understood more readily by reference to the following detailed description of exemplary embodiments and the accompanying drawings. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Hereinafter, an exemplary embodiment of an opening prevention device for a sliding door of a vehicle according to the present invention will be described in detail with reference to the attached drawings. An opening prevention device for a sliding door 2 of a vehicle according to an exemplary embodiment of the present invention may include a vehicle movement detection unit installed within a vehicle body to detect movement of the vehicle, and a door opening prevention unit installed within the vehicle body and to restrain the lateral translation (e.g., sliding movement) of the sliding door 2 when the vehicle movement detection unit detects movement of the vehicle. An opening prevention latch 13 may be installed on the sliding door 2 to be engageable with a portion of the door opening prevention unit.

The vehicle movement detection unit may be installed within the vehicle body and may be configured to detect movement of the vehicle. The sliding door 2 partially ajar or not fully secured may be prevented from opening when the vehicle moves. For example, the vehicle movement detection unit may be configured to detect movement of the vehicle.

A gyro sensor 21 may be used as an example of the vehicle movement detection unit. The gyro sensor 21 may be a sensor that may be configured to determine the speed, attitude and direction of the vehicle when moving. When the vehicle that has been in a stopped state initiates movement (e.g., starts to move), the gyro sensor 21 may be configured to output a signal in response to the movement of the vehicle. Additionally, an acceleration sensor, a speed sensor of the vehicle, or the like may be used as the vehicle movement detection unit. The door opening prevention unit may operate when the vehicle movement detection unit detects movement of the vehicle. In particular, the door opening prevention unit may be installed at a predetermined position within the vehicle body and may function to prevent the sliding door from opening when the vehicle moves.

Figure 2:
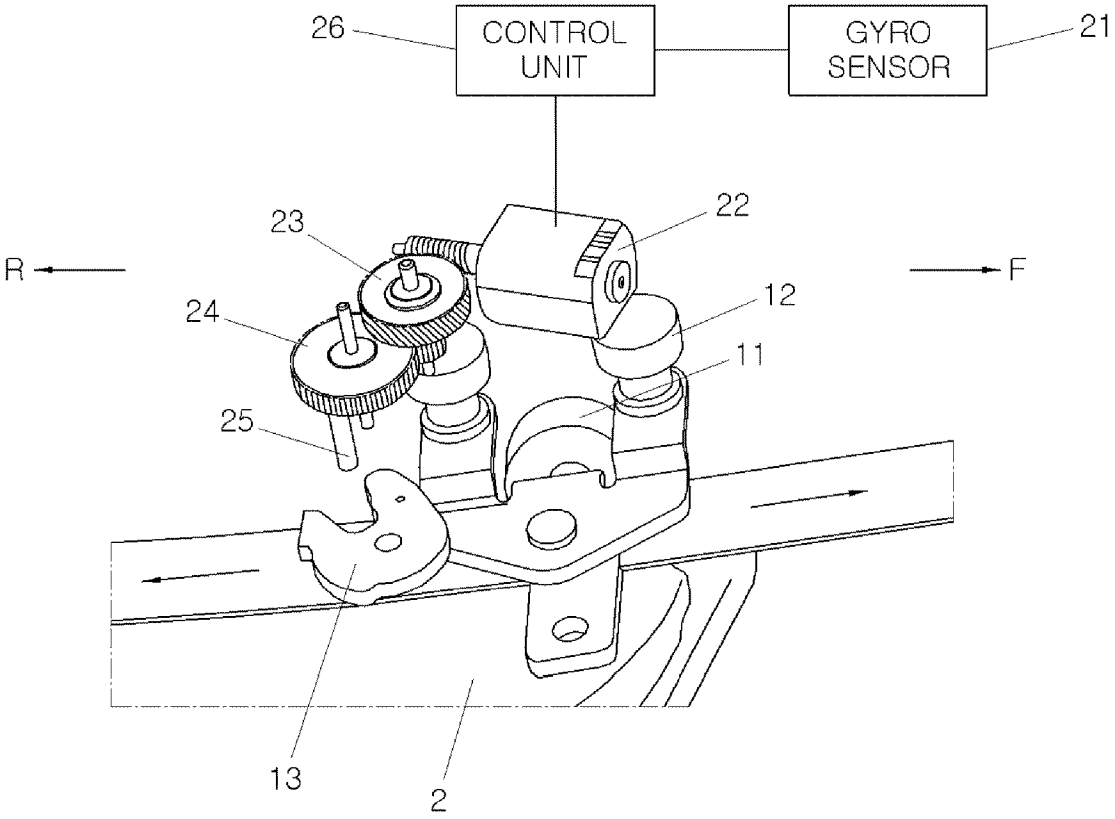
FIG. 2 is an exemplary perspective view illustrating an opening prevention device for a sliding door of a vehicle according to an exemplary embodiment of the present invention.

As shown in FIG. 2, the door opening prevention unit may include a drive motor 22 and a striker 25. The drive motor 22 may be configured to operate in response to a control signal received from a controller 26 when the vehicle movement detection unit detects movement of the vehicle. The striker 25 may be configured to rotate based on whether the vehicle moves or not. To rotate the striker 25, at least one power transmission means, (e.g., gears) may be installed between the drive motor 22 and the striker 25.

For example, as shown in FIG. 2, a first gear 23 and a second gear 24 may be installed between the drive motor 22 and the striker 25. When the first and second gears 23 and 24 are arranged to allow the drive motor 22 to drive the first gear 23 while the first gear 23 drives the second gear 24, the striker 25 may be installed on the second gear 24 which is a final driven gear. The striker 25 may include a rod shape, that protrudes from the second gear 24. Based on whether the vehicle moves or not, the striker 25 may rotate to move into or away from a movement trajectory of the opening prevention latch 13, which will be explained later herein.

The opening prevention latch 13 may be fixed to a predetermined portion of the sliding door 2. In particular, the opening prevention latch 13 may be disposed adjacent to a position at which a lower roller 11 or a guide roller 12 is installed on the sliding door 2. For example, coupled to the sliding door 2, the opening prevention latch 13 may have an overall 'C' shape. The opening prevention latch 13 may be oriented to position with a first end thereof to be coupled to the sliding door 2, and an open second end thereof that protrudes from the sliding door 2. Since the opening prevention latch 13 may be obliquely oriented to allow the open second end to face the striker 25, the striker 25 may engage with the opening prevention latch 13 smoothly and reliably engage upon operation of the opening prevention device.

Moreover, a value output from the vehicle movement detection unit may be input to the controller 26. The controller 26 may be configured to operate the door opening prevention unit. In particular, the controller 26 may be configured to operate the door opening prevention unit when the vehicle movement detection unit detects movement of the vehicle when the sliding door 2 remains partially ajar or is not completely secured (e.g., not completely closed) rather than operating the door opening prevention unit every time the vehicle movement detection unit detects movement of the vehicle and outputs a detection signal. In other words, in response to determining that the sliding door 2 is secured, even though the vehicle movement detection unit detects movement of the vehicle, operating the door opening prevention unit is not required since the sliding door 2 is not capable of opening.

Hereinbelow, the operation of the opening prevention device for sliding doors of vehicles having the above-mentioned construction will be described. As shown in FIG. 2, when the vehicle movement detection unit detects no movement of the vehicle, the door opening prevention unit may not operated. In particular, since the striker 25 may be removed from the movement trajectory of the opening prevention latch 13, the sliding door 2 may laterally translate (e.g., slide) toward the front or rear of the vehicle. For example, when the vehicle is in a stopped state, the sliding door 2 may be opened or closed by lateral translation (e.g., in a sliding manner) toward the front or rear of the vehicle, thus allowing passengers to enter or exit the vehicle.

Figure 3:
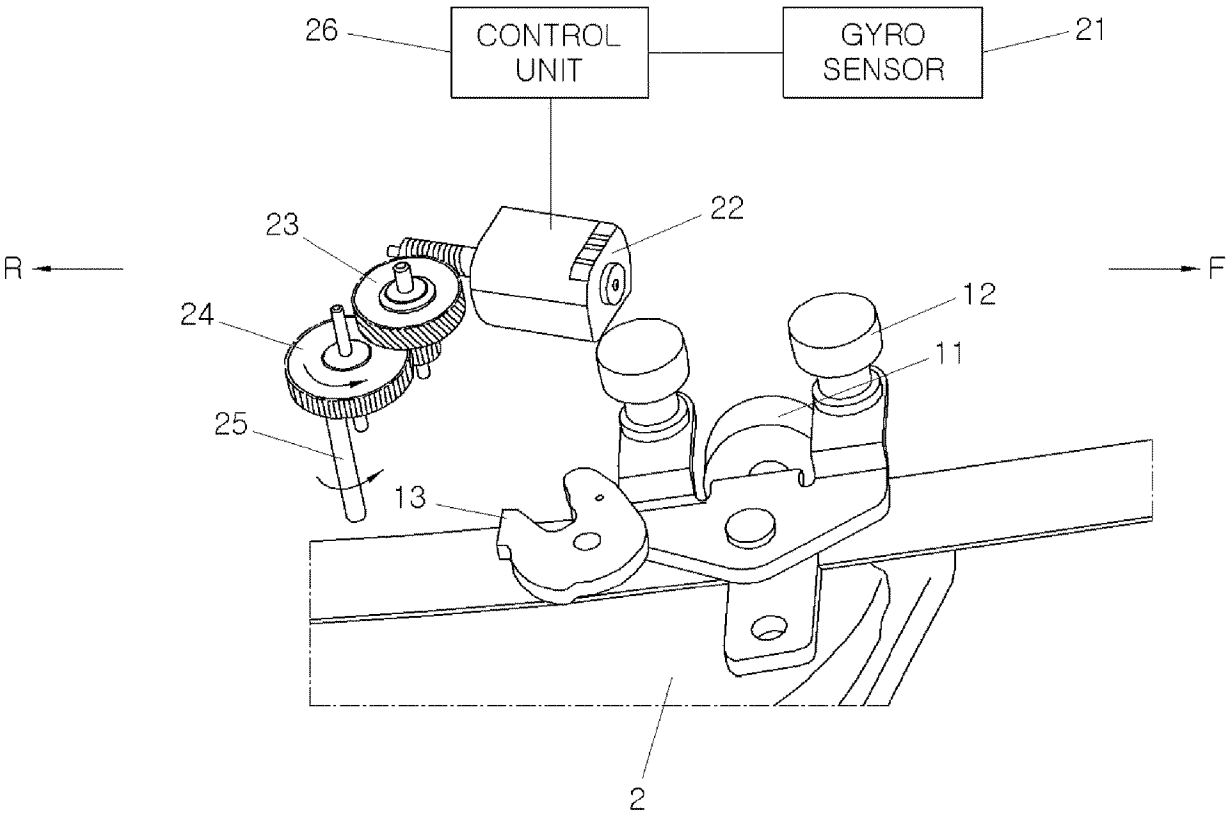
FIG. 3 is an exemplary perspective view illustrating conditions of the opening prevention device in which a striker is rotated from an initial position thereof while the sliding door is in an open state according to an exemplary embodiment of the present invention.

The operation of the opening prevention device when the vehicle starts to move with the sliding door 2 not secured (e.g., completely closed) will be explained with reference to FIGS. 3 and 4. When the vehicle movement detection unit detects movement of the vehicle, the controller 26 may be configured to operate the door opening prevention unit. In particular, the controller 26 may be configured to operate the door opening prevention unit when the vehicle moves with the sliding door 2 unsecured (e.g., not completely closed).

When the door opening prevention unit is operated, the striker 25 may be configured to be rotated from an initial position and disposed on the trajectory that the opening prevention latch 13 moves along. In response to an operating signal received from the controller 26, the drive motor 22 may begin to rotate, and the first gear 23 and the second gear 24 may also be rotated. The striker 25 disposed on the second gear 24 may be rotated from an initial position and disposed at a position adjacent to the sliding door 2. Since the opening prevention latch 13 protrudes from the sliding door 2, the striker 25 may be disposed on the trajectory that the opening prevention latch 13 moves along.

Figure 4:
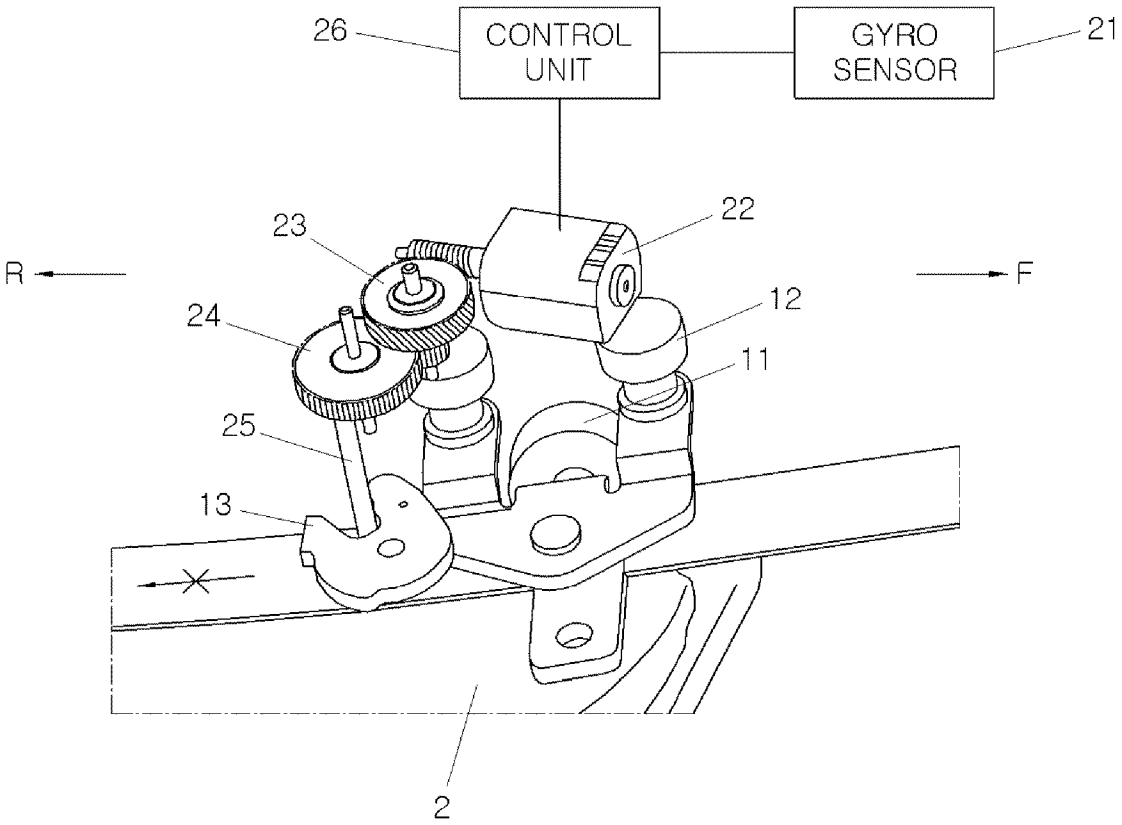
FIG. 4 is an exemplary perspective view illustrating conditions in which opening of the sliding door is prevented by the opening prevention device according to exemplary embodiment of the present invention.

Subsequently, as shown in FIG. 4, when the sliding door 2 is pushed toward the rear (R) of the vehicle by inertial force that results from the forward movement of the vehicle, the opening prevention latch 13 may be engaged by the striker 25. Thereby, the sliding door 2 can no longer translate (e.g., move) toward the rear (R) of the vehicle, thus being prevented from unintentionally opening.

As described above, an opening prevention device for a sliding door of a vehicle according to an exemplary embodiment of the present invention may be configured to detect movement of the vehicle and may be configured to prevent the sliding door from opening when the vehicle moves when the sliding door is not securely closed. Therefore, even when the vehicle begins to move with the sliding door partially ajar or not securely closed, the sliding door may be reliably prevented from being opened by inertial force, whereby an accident of a passenger unintentionally exiting (e.g., falling out) the vehicle during operation may be prevented.

While the present invention has been described with respect to the specific embodiments, it will be apparent to those skilled in the art that various changes and modifications may be made without departing from the spirit and scope of the invention as defined in the following claims.

What is claimed is:

1. An opening prevention device for a sliding door slidably installed in a side surface of a vehicle, the opening prevention device comprising:

a vehicle movement detection unit installed when a vehicle body of the vehicle and configured to detect movement of the vehicle;

a door opening prevention unit installed in the vehicle body and configured to prevent lateral translation of the sliding door when the vehicle movement detection unit detects movement of the vehicle;

an opening prevention latch installed on the sliding door to be engageable with a portion of the door opening prevention unit; and a controller configured to operate the door opening prevention unit when the vehicle movement detection unit detects the movement of the vehicle, wherein the door opening prevention unit includes:

a drive motor; and a striker configured to be rotated by the drive motor, and configured to selectively enter a trajectory of movement of the opening prevention latch based on whether the vehicle movement detection unit detects the movement of the vehicle, and engage with the opening prevention latch, wherein when the vehicle movement detection unit detects the movement of the vehicle, the striker rotates by operation of the drive motor to have the striker enter the trajectory of the movement of the opening prevention latch and engage the opening prevention latch, wherein when the vehicle movement detection unit detects no movement of the vehicle, the striker is maintained in a state removed from the trajectory of the movement of the opening prevention latch, and wherein the opening prevention latch has a 'C' shape with a closed first end and an open second end, wherein the first end is coupled to a portion of the sliding door, and the second end protrudes from the sliding door to receive the striker rotated by operation of the drive motor into the open second end.

2. The opening prevention device according to claim 1, wherein the vehicle movement detection unit includes a gyro sensor.

3. The opening prevention device according to claim 1, wherein the second end of the opening prevention latch engages with the door opening prevention unit when the vehicle movement detection unit detects the movement of the vehicle and operates the door opening prevention unit.

4. The opening prevention device according to claim 1, wherein the opening prevention latch is obliquely oriented to face a portion on which the door opening prevention unit is installed.

5. The opening prevention device according to claim 1, wherein at least one gear is installed on the drive motor, and the striker is disposed on a final driven gear of the at least one gear.

6. The opening prevention device according to claim 5, wherein the striker has a rod shape that protrudes from the final driven gear.

7. The opening prevention device according to claim 1, wherein, when the sliding door is securely fastened to the vehicle body, the controller does not operate the door opening prevention unit although the vehicle movement detection unit detects the movement of the vehicle.

* * * * *